US008319127B2

(12) United States Patent
Yoshida

(10) Patent No.: US 8,319,127 B2
(45) Date of Patent: Nov. 27, 2012

(54) ELECTRONIC APPARATUS

(75) Inventor: Takashi Yoshida, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 288 days.

(21) Appl. No.: 12/706,194

(22) Filed: Feb. 16, 2010

(65) Prior Publication Data

US 2010/0206707 A1 Aug. 19, 2010

(51) Int. Cl.
*H01H 9/12* (2006.01)

(52) U.S. Cl. ..... 200/305

(58) Field of Classification Search ..... 200/516, 200/305, 304, 517, 512, 513
See application file for complete search history.

(56) References Cited

U.S. PATENT DOCUMENTS

| | | | | |
|---|---|---|---|---|
| 5,664,667 | A * | 9/1997 | Kenmochi | 200/305 |
| 6,207,912 | B1 | 3/2001 | Persson | |
| 6,580,043 | B1 * | 6/2003 | Spratte | 200/517 |
| 7,342,193 | B2 * | 3/2008 | Chang et al. | 200/305 |

FOREIGN PATENT DOCUMENTS

| | | |
|---|---|---|
| JP | 2001-513941 | 9/2001 |
| JP | 2004-311088 | 11/2004 |

* cited by examiner

*Primary Examiner* — Felix O Figueroa
(74) *Attorney, Agent, or Firm* — Carter DeLuca Farrell & Schmidt, LLP

(57) ABSTRACT

An electronic apparatus includes an operation member which includes an operation portion, a substrate which includes a switch detecting pattern and a ground pattern, and a sheet member which is disposed between the operation member and the substrate and provided with a metal piece for causing the switch detecting pattern to be electrically continuous to the ground pattern according to an operation to the operation portion, wherein the metal piece is in contact with the ground pattern, and the sheet member covers the metal piece with an insulating member in such a manner that at least a part of a surface of the metal piece is exposed.

6 Claims, 10 Drawing Sheets

ELECTRONIC APPARATUS

BACKGROUND OF THE INVENTION

1. Field of the Invention

The present invention relates to an electronic apparatus and particularly a technique for protecting a substrate in an operation portion from an electrostatic discharge.

2. Description of the Related Art

Conventionally, an operation portion of an electronic apparatus has adopted a structure which covers a metal dome with an insulating sheet to protect the operation portion from an electrostatic discharge. For example, a technique for covering a metal dome with an insulating sheet in order to protect an electronic circuit board from an electrostatic discharge is discussed in Japanese Patent Application Laid-Open No. 2001-513941.

However, in the conventional technique, when static electricity enters inside from a gap between an exterior cover and an operation button, the static electricity is discharged to an electronic component on the electronic circuit board. Thus, protection of the electronic circuit board is not sufficient.

Further, if the operation button is configured by a conductive member, the conductive member is electrically independent. Thus, a charge of the static electricity is accumulated on the operation button, so that a secondary discharge of the static electricity may be generated. Consequently, an electrostatic discharge may be generated to electronic component or the like on the electronic circuit board. Thus, the conventional technique has been lacking for protection of the electronic circuit board.

FIG. 10A illustrates a partial cross sectional view around an operation button in a conventional operation portion. Further, an enlarged view around a contact point of the operation button is illustrated in FIG. 10B.

In FIG. 10A, the operation portion includes a cover member 101 as an exterior cover, an operation button 108, and a pusher 121 of the operation button 108. A metal dome 131 and an insulating sheet 132 form a metal dome sheet. The operation portion further includes an electronic circuit board 140, an electronic component 141 such as a light emitting diode (LED) disposed on the electronic circuit board, a switch detecting pattern 142 on the electronic circuit board, and a ground pattern 143 on the electronic circuit board.

An adhesive material 130 is used for bonding the metal dome sheet to the electronic circuit board 140, and includes, for example a double-sided tape or the like. The adhesive material 130 is provided with one or more holes so that the metal dome 131 is brought into contact with the electronic circuit board 140 when the metal dome 131 is pressed by the pusher.

The metal dome 131 is covered with the insulating sheet 132. When static electricity is discharged, as a path 150*a* in FIG. 10A, the static electricity enters inside from a gap between the cover member 101 and the operation button 108. Although the metal dome 131 is covered with the insulating sheet 132 and is protected from the static electricity, the electronic component 141 is exposed on the electronic circuit board 140 and the static electricity travels in the air as illustrated by the path 150*a* and is discharged. Thus, the static electricity will travel to the electronic circuit board 140 via the electronic component 141 and affect them. Therefore, in this case, it is necessary to provide an electric grounding by another conductive material to prevent occurrence of a discharge or a secondary discharge of the static electricity.

SUMMARY OF THE INVENTION

According to an aspect of the present invention, an electronic apparatus includes an operation member which includes an operation portion, a substrate which includes a switch detecting pattern and a ground pattern, and a sheet member which is disposed between the operation member and the substrate and provided with a metal piece for causing the switch detecting pattern to be electrically continuous to the ground pattern according to an operation to the operation portion, wherein the metal piece is in contact with the ground pattern, and the sheet member covers the metal piece with an insulating member in such a manner that at least a part of a surface of the metal piece is exposed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
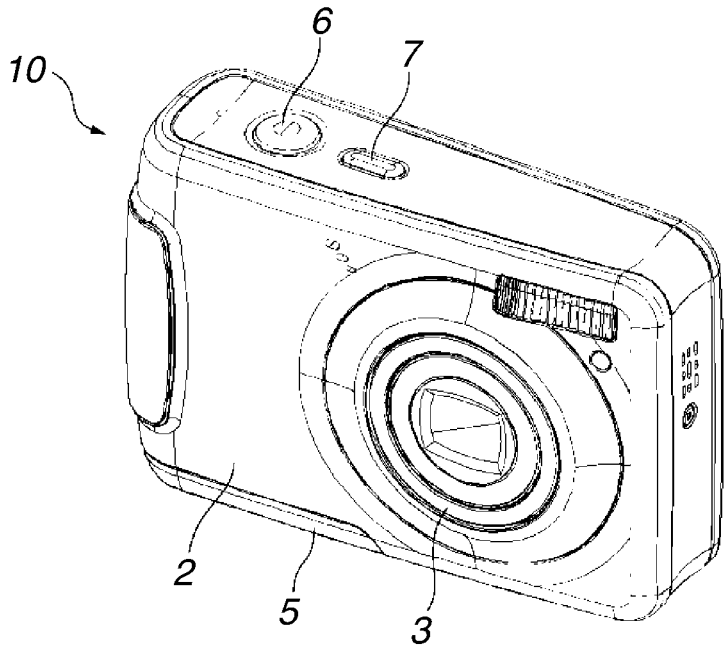
FIGS. 1A and 1B illustrate outline views of a digital camera according to an exemplary embodiment of the present invention.
Figure 1B:
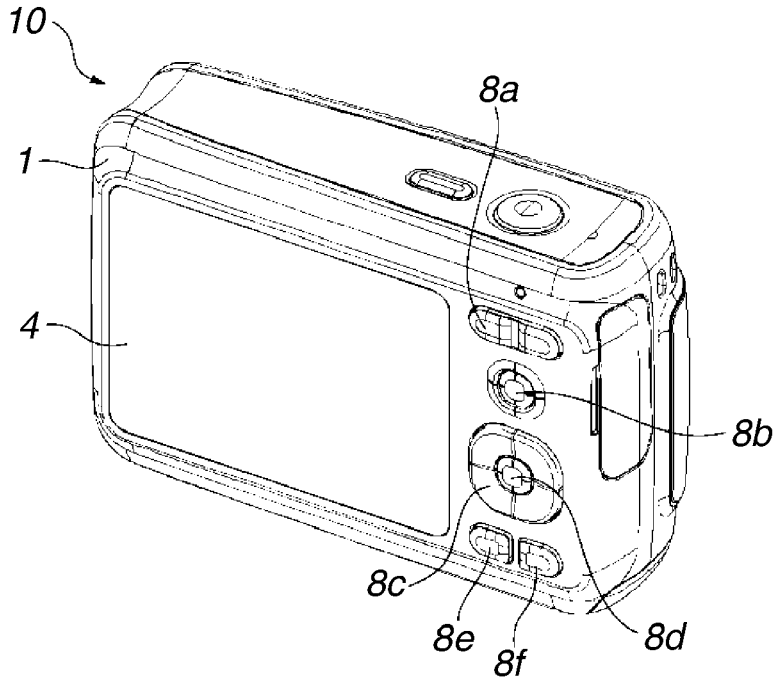

FIGS. 1A and 1B are perspective views of a digital camera as an example of an electronic apparatus according to a first exemplary embodiment of the present invention. FIG. 1A illustrates a perspective view on a front side. FIG. 1B illustrates a perspective view on a rear side.

In a digital camera 10, a main part of an exterior is configured by a cover member (rear cover) 1 and a cover member (front cover) 2. Further, the digital camera 10 includes a lens unit 3, a display unit 4 for displaying a captured image, and a battery cover 5 for covering a battery storage unit.

Furthermore, the digital camera 10 includes a release button 6 for instructing an image capture operation, an electric power source button 7 for instructing ON/OFF of an electric power source, and operation buttons 8*a* to 8*f* (operation portion) for performing various types of operation. The operation buttons 8*a*, 8*b*, 8*c*, 8*d*, and 8*e* are respectively allocated to a zoom button, a reproduction button, a four-direction button, a determination button, a mode button, and a menu button.

Next, a configuration around an operation button of the digital camera in FIG. 1 will be described using FIG. 2.

Figure 2:
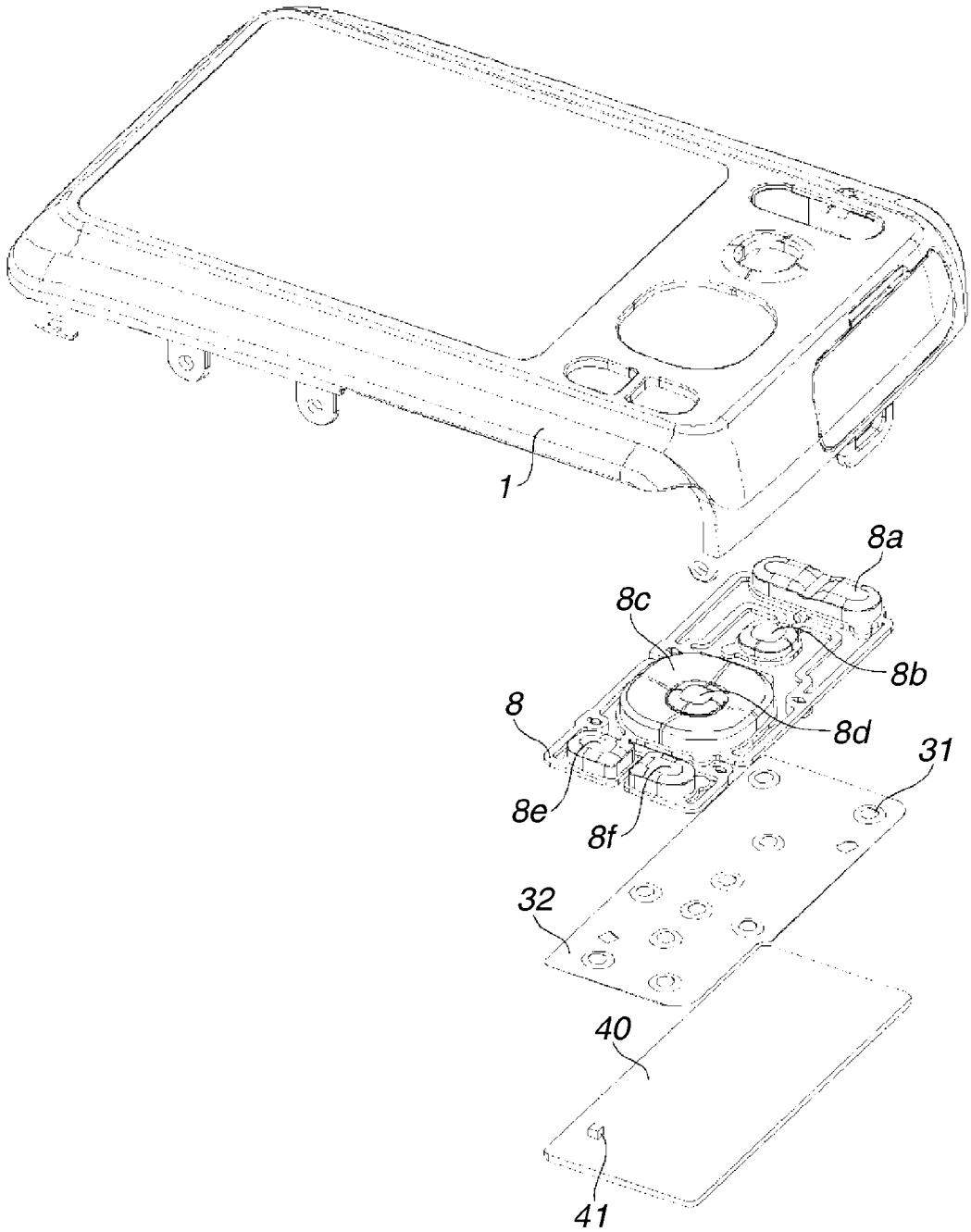
FIG. 2 is an exploded perspective view illustrating a configuration around an operation button of a digital camera.

FIG. 2 is an exploded perspective view illustrating a configuration around an operation portion of the digital camera 10 in FIG. 1.

Inside the rear cover 1 (in cover member), an operation member 8 on which a plurality of operation buttons 8*a* to 8*f* has been formed, a metal dome sheet (sheet member) including a metal dome 31 and an insulating sheet 32 which will be described below, and an electronic circuit board (substrate) 40 are assembled in this order. The metal dome sheet includes the metal dome 31. The metal dome sheet is elastically deformed by a pressing operation of the operation button 8*a* or the like and is electrically connected to a contact point on the electronic circuit board. When the pressing operation is released, the metal dome sheet is restored from a deformation state and releases connection to the contact point.

Next, a structure of the operation button in FIG. 2 will be described using FIGS. 3 to 8.

Figure 3:
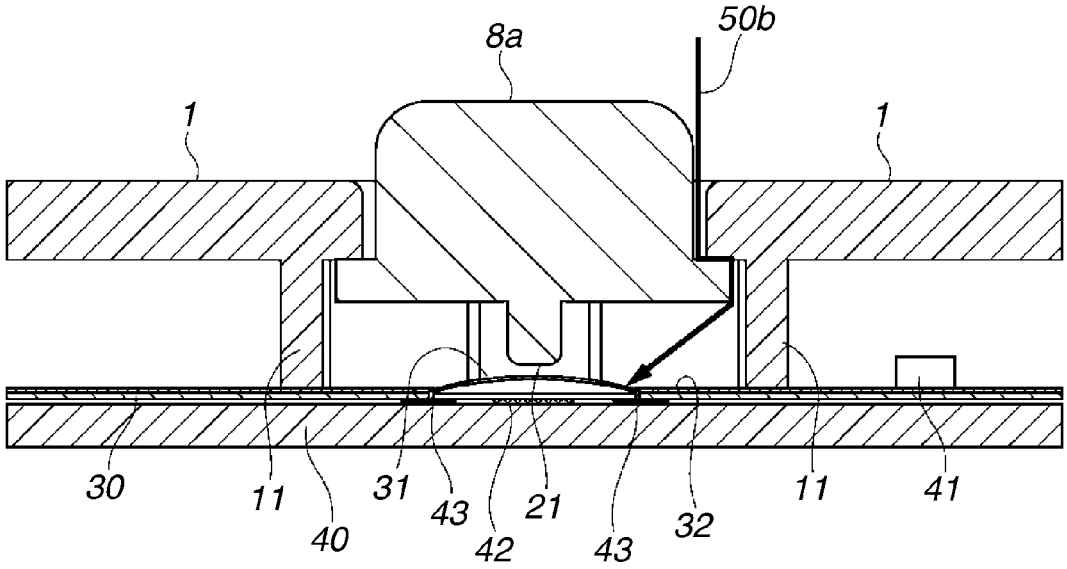
FIG. 3 is a cross sectional view illustrating a structure of an operation button.
Figure 4:
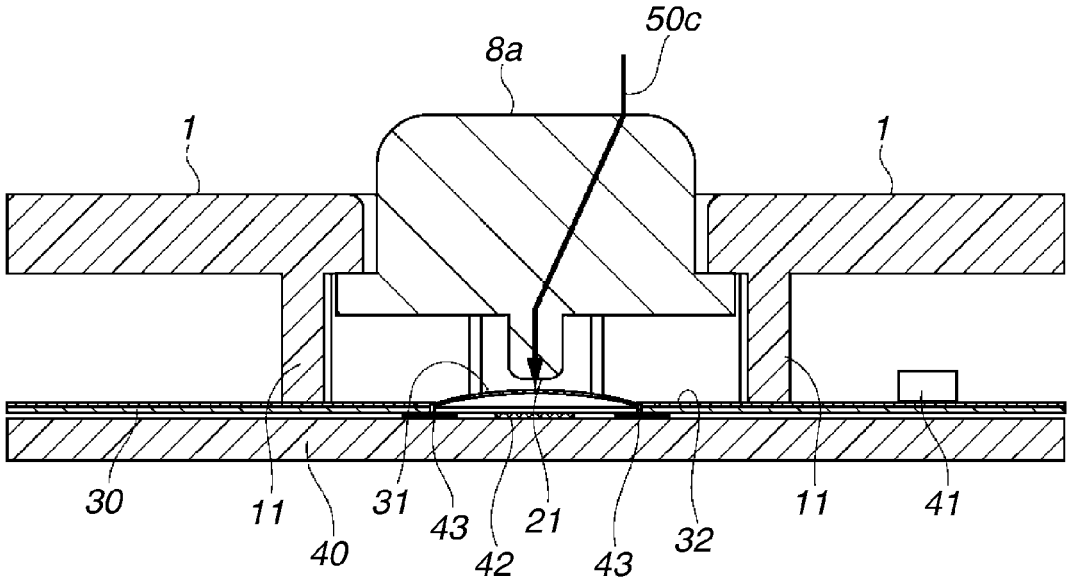
FIG. 4 is a cross sectional view illustrating a structure of an operation button.
Figure 5:
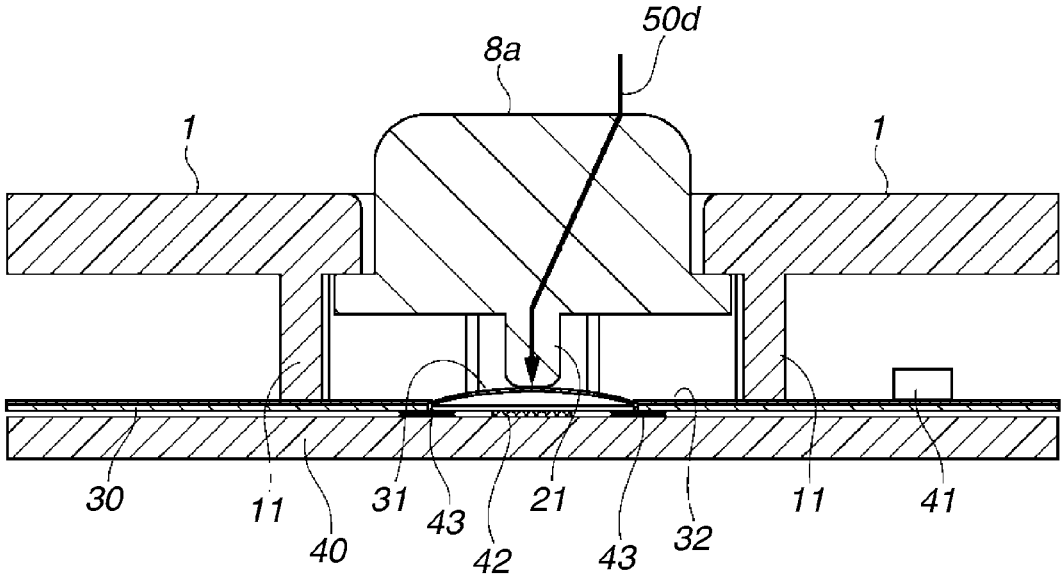
FIG. 5 is a cross sectional view illustrating a structure of an operation button.
Figure 6:
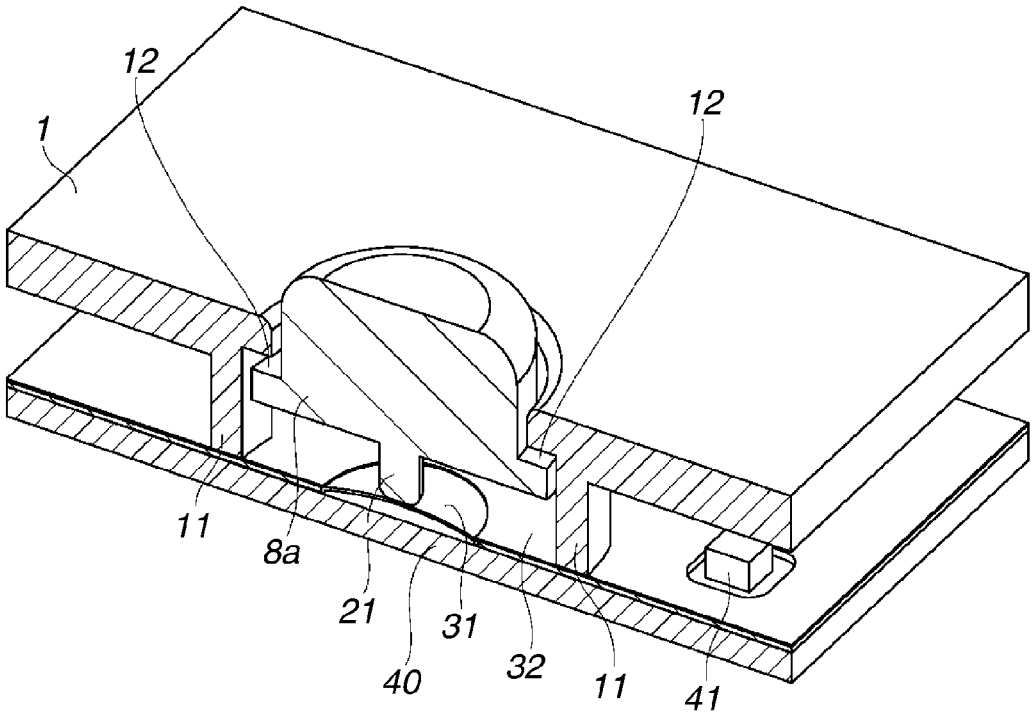
FIG. 6 is a cross sectional perspective view illustrating a structure of an operation button.
Figure 7:
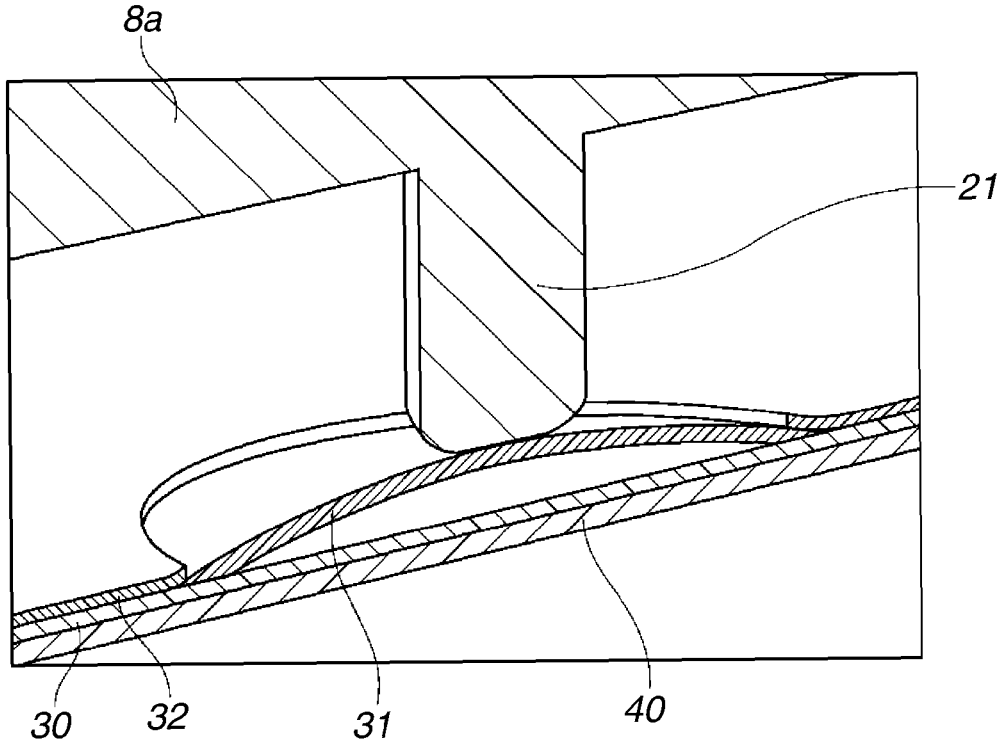
FIG. 7 is a cross sectional view enlarged with the vicinity of a contact point of an operation button.
Figure 8:
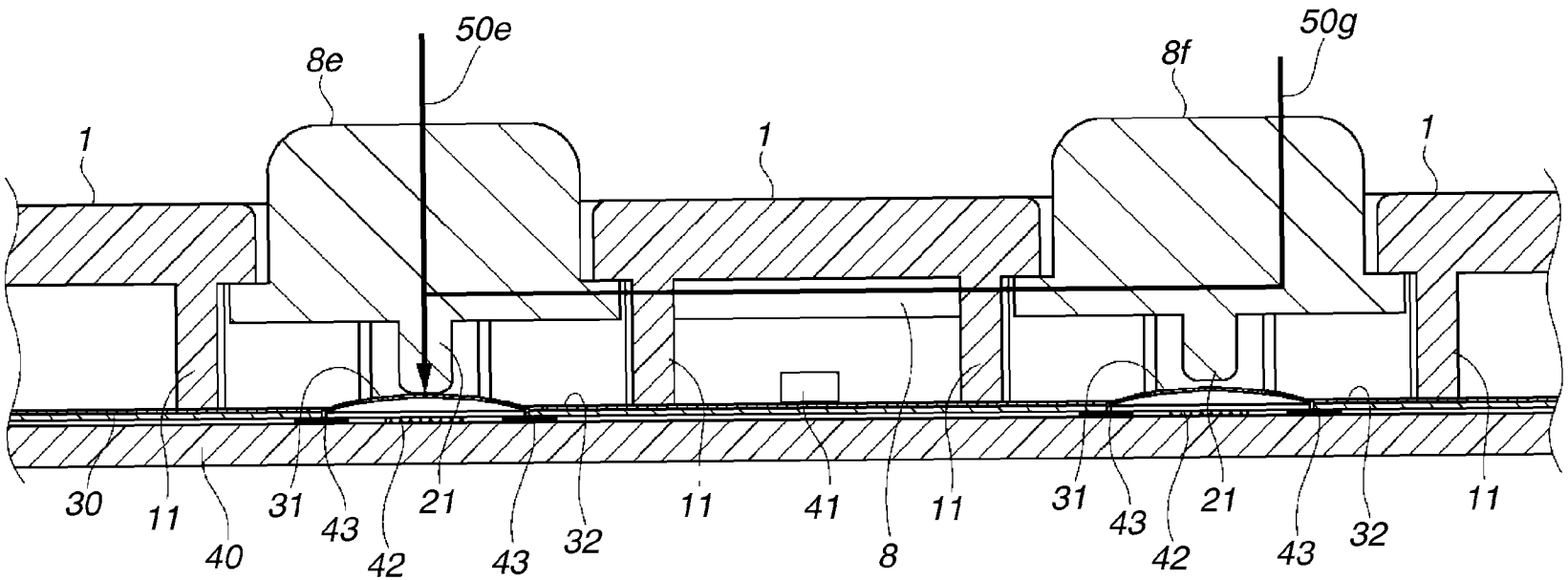
FIG. 8 is a cross sectional view illustrating a structure of a plurality of operation buttons.

FIGS. 3 to 5 are partial cross sectional views around the operation button. FIG. 6 is a cross sectional perspective view illustrating a structure of the operation button. FIG. 7 is a partial cross sectional perspective view enlarged with the vicinity of a contact point of the operation button. FIG. 8 is a cross sectional view illustrating a structure of a plurality of operation buttons. In the illustrated example, the operation buttons 8*a*, 8*e* and 8*f* are shown. However, the operation buttons are not limited thereto.

On the operation member 8, the operation buttons (key top) 8*a* to 8*f* are formed in predetermined positions. Each of the operation buttons penetrates through a hole formed on the rear cover 1 and is exposed to outside of a housing of the digital camera 10. On a rear side of each of the operation buttons 8*a* to 8*f*, a protruded pusher 21 for bending the metal dome 31 is formed.

In the metal dome sheet, a dish-shaped metal dome 31 (metal piece) is provided at a predetermined position of a flexible film-like insulating sheet 32. The metal dome 31 is disposed in a direction that a recessed surface thereof faces the electronic circuit board 40. The insulating sheet (insulating member) 32 covers the metal dome 31 such that at least a part of the surface of the metal dome 31 is exposed. In the present exemplary embodiment, an opening of the insulating sheet 32 is provided to expose a center of the metal dome 31, which is a position at which the pusher 21 is brought into contact with the metal dome 31 in the pressing operation.

However, the position where the opening of the insulating sheet 32 is provided is not limited to the position at which the pusher 21 is brought into contact with the metal dome 31 in the pressing operation, but may be provided around an edge portion of the metal dome 31 at which the pusher 21 is not brought into contact with the metal dome 31.

The metal dome sheet and the electronic circuit board 40 are bonded with each other by an adhesive material 30 such as a double-sided tape. The adhesive material 30 is provided with one or more holes so that the metal dome 31 is brought into contact with the electronic circuit board 40 in the pressing operation.

When any of the operation buttons 8*a* to 8*f* is pressed, the pusher 21 formed on the back of the pressed operation button deforms the metal dome 31. The metal dome 31 is in contact with a ground pattern 43 on the electronic circuit board 40. Consequently, when the metal dome 31 is deformed and brought into contact with a switch detecting pattern 42 provided on the electronic circuit board 40, the switch detecting pattern 42 and the ground pattern 43 are electrically connected to each other. Thus, ON/OFF of the operation button can be detected.

FIG. 3 illustrates a case where static electricity is discharged and enters inside from a gap between the rear cover 1 and the operation button 8*a*. Since a part of the metal dome 31 is exposed, the static electricity entering the inside travels in the air as illustrated by a path 50*b* and directly reaches the metal dome 31. Then, since the metal dome 31 is in contact with the ground pattern 43 on the electronic circuit board 40, the reached static electricity can be dissipated.

According to the exemplary embodiment of the present invention, the operation button 8*a* may contain a conductive member such as a plastic plate or a metal. Such a case is illustrated in FIG. 4.

FIG. 4 illustrates a case where static electricity is discharged and directly reaches the operation button 8*a*.

In FIG. 4, the operation button 8*a* is electrically independent, and a charge of the static electricity is accumulated on the operation button 8*a* and a secondary discharge is generated. A part of the metal dome 31 is exposed from the opening of the insulating sheet 32. Thus, the static electricity is secondarily discharged from the protruded pusher 21 provided on the operation button 8*a* as illustrated by a path 50*c*, travels in the air, and directly reaches the metal dome 31. Then, since the metal dome 31 is in contact with the ground pattern 43 on the electronic circuit board 40, the reached static electricity can be dissipated.

The operation button 8*a* may contain, for example, a conductive member and have a structure in which the pusher 21 provided thereon is always in contact with the exposed metal dome 31. Such a case is illustrated in FIG. 5.

FIG. 5 illustrates a case where static electricity is discharged and directly reaches the operation button 8*a*. Unlike FIG. 4, in FIG. 5, the pusher 21 is in contact with the metal dome 31. Thus, the static electricity directly reached the operation button 8*a* further reaches the metal dome 31 via the pusher 21 of the operation button 8*a* as illustrated by a path 50*d*, and may be dissipated from the ground pattern 43 on the electronic circuit board 40.

The exemplary embodiment of the present invention may include a structure in which a plurality of operation buttons which contains a conductive member is mutually electrically connected by the operation member 8. Further, in the structure, the pusher 21 of at least one operation button among the plurality of the mutually connected operation buttons may be continuously in contact with the exposed metal dome 31. Such a case is illustrated in FIG. 8.

In FIG. 8, the operation buttons 8*e* and 8*f* are mutually connected by a button sheet, and the pusher 21 provided on the operation button 8*e* is continuously in contact with the exposed metal dome 31. Thus, when the static electricity is discharged and directly reaches the operation button 8*e*, the static electricity can be dissipated from the ground pattern 43 on the electronic circuit board 40 via the metal dome 31 from the operation button 8*e* as illustrated by a path 50*e*.

On the other hand, when the static electricity is discharged and directly reaches the operation button 8*f*, the static electricity can be dissipated from the ground pattern 43 on the electronic circuit board 40 via the operation member 8, the operation button 8*e* and the metal dome 31 from the operation button 8*f*. Thus, if the static electricity is discharged around any one of the plurality of mutually connected operation buttons, the electronic circuit board 40 can be protected.

In FIGS. 3 to 8, the rear cover 1 includes ribs 11 around the metal dome 31 from the rear cover 1 to toward the insulating sheet 32.

As illustrated in FIG. 5, in a case where the pusher 21 of the operation button 8*a* is in contact with the exposed metal dome 31, and when the rear cover 1 is pressed, the operation button 8*a* may be pressed together and the metal dome 31 may be actuated. Thus, a malfunction may occur.

In such a case, by providing a rib which is protruded in a direction from the rear cover 1 to the metal dome sheet and disposing the ribs 11 around the metal dome 31, the operation button 8*a* can be protected from being pressed if the rear cover 1 is pressed. Thus, a malfunction can be prevented.

In FIG. 6, a gap 12 is provided between the rear cover 1 and the operation button 8*a* in a direction that the operation button 8*a* is pressed. By providing the gap 12 between the rear cover 1 and the operation button 8*a* in the pressing direction of the operation button 8*a*, the operation button 8*a* can be protected from being pressed if the rear cover 1 is pressed. Thus, a malfunction can be prevented. FIG. 6 illustrates a configuration in which both the rib 11 and the gap 12 are provided. However, a configuration in which the rib 11 is not provided and only the gap 12 is provided can achieve an effect of preventing a malfunction. However, a configuration in which both the rib 11 and the gap 12 are provided can reliably prevent a malfunction compared with a configuration in which only the gap 12 is provided.

In an electronic apparatus according to a second exemplary embodiment of the present invention, the configuration (FIGS. 1 and 2) is similar to the electronic apparatus in the above-described first exemplary embodiment. Thus, in apart similar to that of the first exemplary embodiment, the same reference numeral is used and its description is omitted. Only a point different from the above described first exemplary embodiment will be described below.

Figure 9:
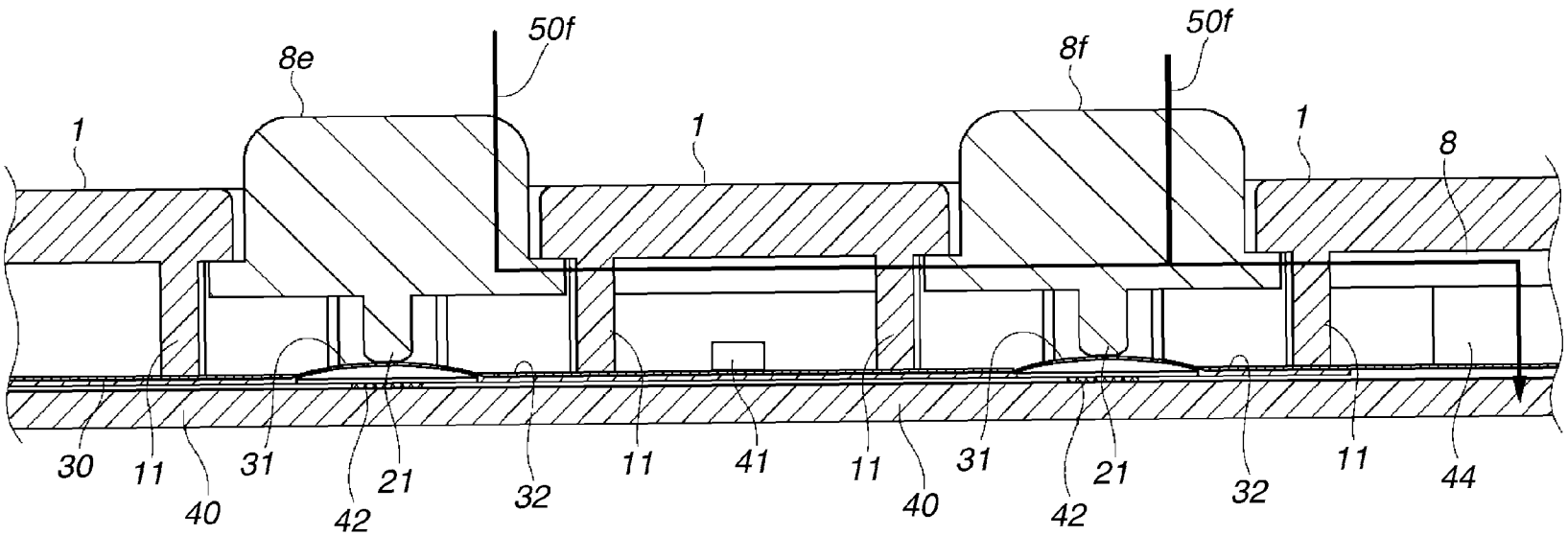
FIG. 9 is a cross sectional view illustrating a structure of a plurality of operation buttons of a digital camera according to a second exemplary embodiment of the present invention.
Figure 10A:
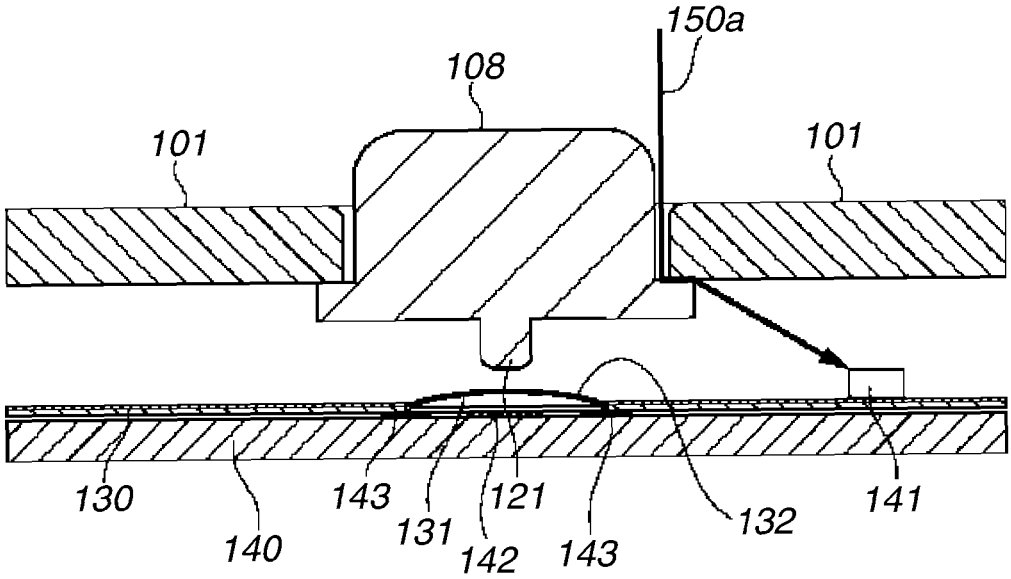
FIG.10A PRIOR ART
FIGS. 10A and 10B are cross sectional views illustrating a conventional operation button.
Figure 10B:
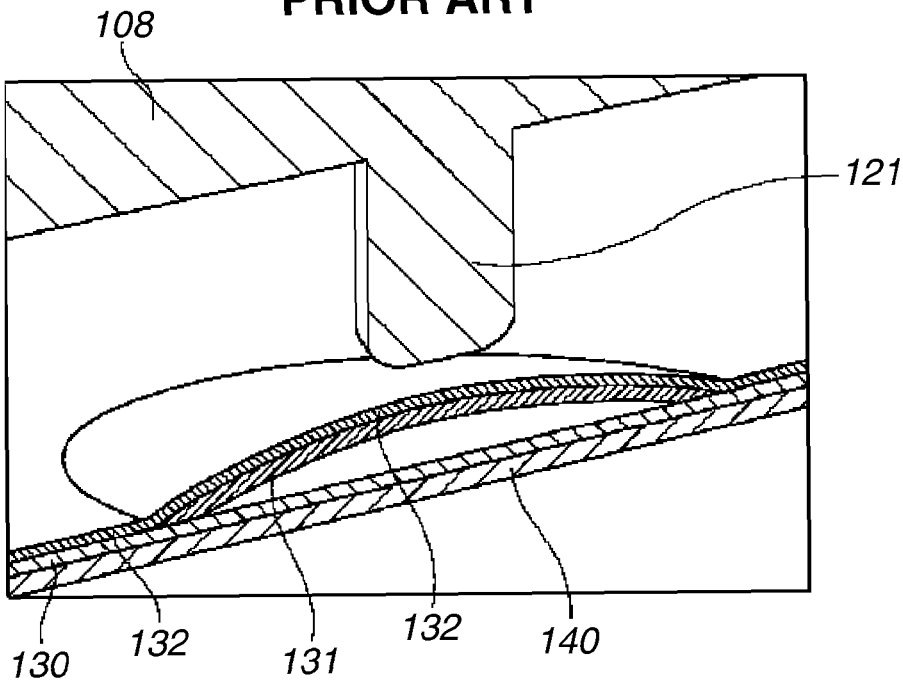
FIG.10B PRIOR ART

FIG. 9 illustrates a partial cross sectional view around a plurality of operation buttons of a digital camera according to the second exemplary embodiment.

Around the operation buttons in the present exemplary embodiment, conductive rubber 44 is disposed so as to be pressed to the electronic circuit board 40 to have a structure to be connected to with a main body grounding (not shown). In this case, discharged static electricity is dissipated from the conductive rubber 44 to the main body grounding via the operation button 8*e* and the operation member 8 as illustrated by a path 50*f*. Thus, the electronic circuit board 40 can be protected from the static electricity.

Since the operation buttons 8*e* and 8*f* are connected to the main body grounding via the conductive operation member 8 and the conductive rubber 44, for example, when the pusher 21 of the operation button 8*a* is in contact with the metal dome 31, the metal dome 31 will be electrically connected to the grounding. Therefore, the ground pattern 43 on the electronic circuit board 40 can be removed and a degree of freedom of wiring can be enhanced.

The exemplary embodiment of the present invention has been described above. However, the present invention is not limited to these exemplary embodiments and various modifications and changes can be made within the scope of the invention.

In the above-described two exemplary embodiments, the structure of the operation buttons 8*a* to 8*f* is described in detail, but the present invention may be applied to another button. For example, a button that detects ON/OFF of a switch when the metal dome 31 which is pressed and deformed is brought into contact with the switch detecting pattern 42 provided on the electronic circuit board 40 may be applied to a release button 6, an electric power source button 7, or the like.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-033903 filed Feb. 17, 2009, which is hereby incorporated by reference herein in its entirety.

What is claimed is:

1. An electronic apparatus comprising:

an operation member which includes an operation portion;

a substrate which includes a switch detecting pattern and a ground pattern; and a sheet member which is disposed between the operation member and the substrate and provided with a metal piece for causing the switch detecting pattern to be electrically continuous to the ground pattern according to an operation to the operation portion, wherein the metal piece is in contact with the ground pattern, wherein the sheet member covers the metal piece with an insulating member in such a manner that at least a part of a surface of the metal piece is exposed.

2. The electronic apparatus according to claim 1, wherein the operation portion is conductive and when an operation is not executed to the operation portion, a pusher provided on the operation portion is in contact with the exposed surface of the metal piece.

3. The electronic apparatus according to claim 1, wherein the operation member includes a plurality of conductive operation portions, wherein at least one of the plurality of operation portions is provided with a pusher which is in contact with the exposed surface of the metal piece when operation is not executed, and an operation portion on which the pusher is not provided among the plurality of operation portions is electrically continuous to the operation portion on which the pusher is provided.

4. The electronic apparatus according to claim 1, further comprising:

a cover member which constitutes an exterior of the electronic apparatus, wherein the cover member includes a rib which is protruded in a direction from the cover member to the sheet member, and the rib is disposed around the metal piece.

5. The electronic apparatus according to claim 4, wherein a gap is provided between the cover member and the operation member in a direction that the operation member is pressed.

6. An electronic apparatus comprising:

an operation member which includes a conductive operation portion;

a substrate which includes a switch detecting pattern;

a main body grounding which is electrically continuous to the operation member; and a sheet member which is disposed between the operation member and the substrate and provided with a metal piece for causing the switch detecting pattern to be electrically continuous to the main body grounding according to an operation to the operation portion, wherein the sheet member covers the metal piece with an insulating member in such a manner that at least a part of a surface of the metal piece is exposed.

* * * * *